United States Patent [19]

Matsumiya et al.

[11] 4,435,276

[45] Mar. 6, 1984

[54] METHOD OF TREATING HEAVY OIL

[75] Inventors: Saburo Matsumiya, Chiba; Koichi Washimi, Tokorozawa; Tsuneo Tanji, Chiba, all of Japan

[73] Assignee: Toyo Engineering Corporation, Tokyo, Japan

[21] Appl. No.: 416,394

[22] Filed: Sep. 9, 1982

[30] Foreign Application Priority Data

Apr. 9, 1982 [JP] Japan ..... 57-57993

[51] Int. Cl.[3] ..... C10G 55/04

[52] U.S. Cl. ..... 208/96; 208/106

[58] Field of Search ..... 208/96, 131, 106

[56] References Cited

U.S. PATENT DOCUMENTS

| | | | |
|---|---|---|---|
| 2,696,458 | 12/1954 | Strickland | 208/96 |
| 2,717,865 | 9/1955 | Kimberlin, Jr. et al. | 208/106 |
| 2,847,353 | 8/1958 | Beavon | 208/96 |
| 2,850,431 | 9/1958 | Smith | 208/96 |
| 2,875,149 | 2/1959 | Beavon | 208/96 |
| 2,914,457 | 10/1959 | Beavon | 208/96 |
| 3,053,750 | 9/1962 | Beuther et al. | 208/96 |
| 3,194,753 | 7/1965 | Winter | 208/106 |

*Primary Examiner*—Delbert E. Gantz
*Assistant Examiner*—Glenn A. Caldarola
*Attorney, Agent, or Firm*—Flynn, Thiel, Boutell & Tanis

[57] ABSTRACT

In a method of treating heavy oil, in which a gas and a volatile oil fraction produced by thermally decomposing petroleum heavy oil are distilled off, a thermal decomposition residue withdrawn in the liquid state is brought into contact with a part of the volatile oil fraction as a solvent to extract the solven-soluble component in the thermal decomposition residue, and then an extraction residue is separated as solid particles from the solvent, an improvement is disclosed which comprises fractionating the volatile oil fraction used as the solvent into two or more sub-fractions having different boiling points from each other on condensing the volatile oil fraction in a fractionating column, and contacting the sub-fractions thus-fractionated with the thermal decomposition residue progressively from the highest boiling to the lowest boiling of the fractions to extract a solvent-soluble component.

10 Claims, 1 Drawing Figure

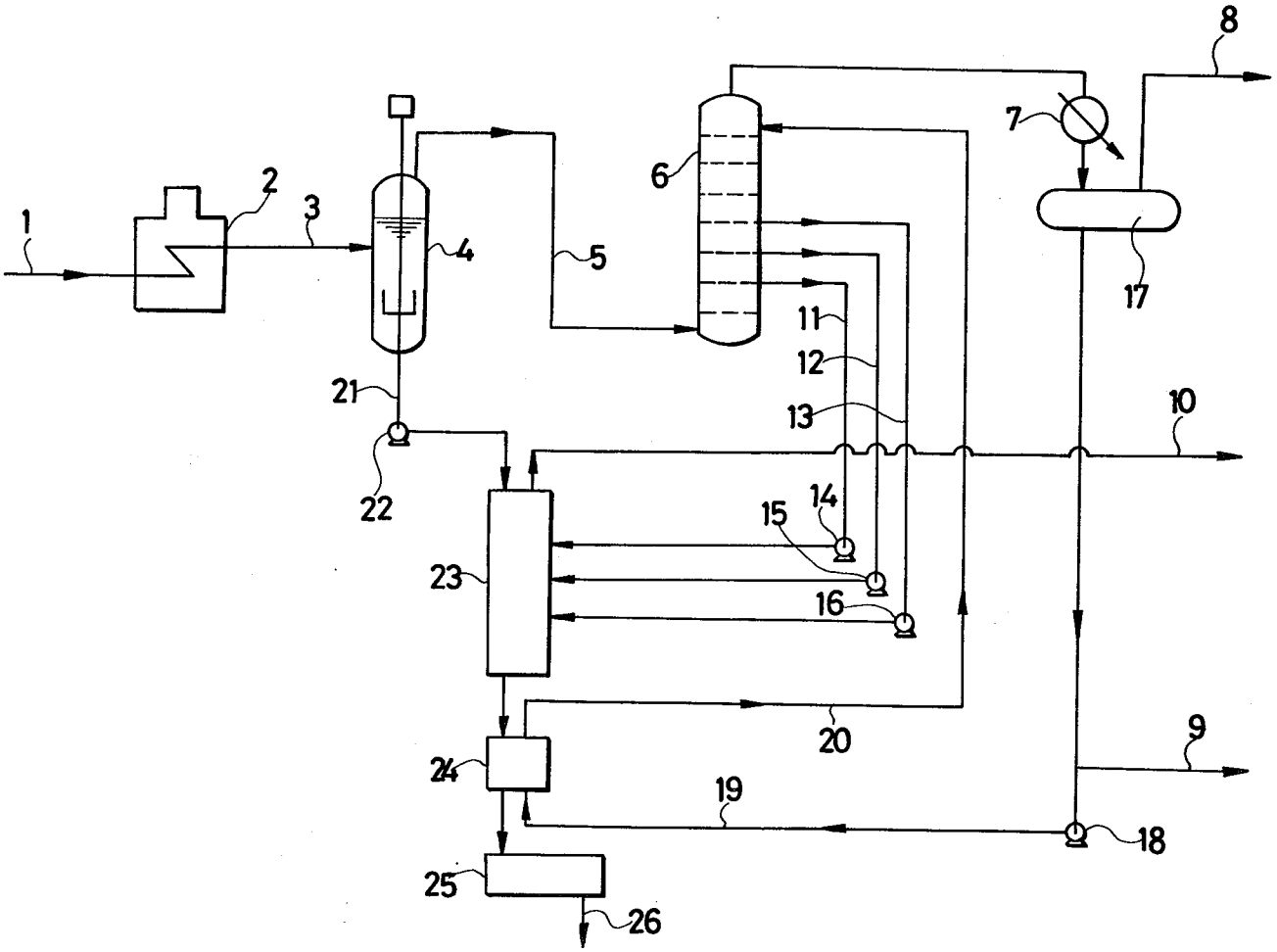
1
2
3
4
5
6
7
8
9
10
11
12
13
14
15
16
17
18
19
20
21
22
23
24
25
26

METHOD OF TREATING HEAVY OIL

This invention relates to an improvement in a thermal decomposition method of treating petroleum heavy oil.

In the thermal decomposition of petroleum heavy oil, decomposition and polycondensation reactions take place simultaneously with the passing of reaction time and, eventually, a gas, a volatile oil fraction and a non-volatile thermal decomposition residue are produced by the thermal decomposition. It is well known that, generally, the non-volatile decomposition residue of heavy oil, which contains relatively high levels of sulfur and heavy metals, is useful only for an extremely narrow range of purposes, and such residue is of less value than the volatile oil fraction. Accordingly, it is the conventional practice to use the so-called coking process for the thermal cracking of petroleum heavy oil, in which the thermal decomposition reaction is carried out under severe conditions so as to increase the yield of the volatile oil fraction as much as possible.

However, the coking process has the disadvantage that a large amount of energy is needed, and evolution of gas, especially hydrogen produced by dehydrogenation, concurrently takes place whereby to increase the yield of the volatile oil fraction as well as that of the gas thus-produced, and simultaneously to lighten and destabilize the volatile oil fraction. The destabilization of the volatile oil fraction is caused by the increase in the number of double bonds due to dehydrogenation. Such destabilization of the volatile oil fraction requires a subsequent hydrogenation treatment of the volatile oil fraction using expensive hydrogen, which is uneconomical.

The supply-demand relationship for petroleum products in Japan has a tendency to result in shortages of the intermediate oil fraction, rather than the light oil fraction. It is desirable, from the aforesaid standpoint, to avoid lightening of the volatile oil fraction to an excessive extent by avoiding the consumption of an unnecessarily large amount of energy in the thermal decomposition reaction. This excessive lightening of the volatile oil fraction generated by thermal decomposition, as well as the excessive progress of the dehydrogenation reaction as described above, can be controlled by conducting the thermal decomposition under mild conditions, but such a thermal decomposition under mild conditions has the disadvantage that a considerable amount of heavy oil remains in the thermal decomposition residue, and the yield of the volatile oil fraction is thereby reduced.

The present inventors previously proposed a method of extracting a soluble fraction present in the thermal decomposition residue by contacting the thermal decomposition residue with a part of the volatile oil fraction that was produced by the thermal decomposition or with heavy oil, used as an extraction solvent. According to the aforesaid method, the oil used as the extraction solvent, which becomes contained in the solid extraction residue or clings to the surface thereof, must be removed and recovered, but the removal and recovery thereof by evaporation is difficult when the boiling point range of the extraction solvent oil is a high temperature range.

Moreover, a high-boiling extraction solvent oil generally has a high viscosity so that the separation of the extraction residue therefrom by sedimentation or filtration is difficult. On the other hand, a final washing step, for replacing the residual heavy extraction solvent oil with a light oil having a relatively low temperature boiling point range and a low viscosity, allows easy separation and recovery of the residual heavy solvent, but the subsequent regeneration of the light oil containing the heavy solvent oil requires the evaporation of all of the light oil, resulting in a large amount of energy loss.

An object of this invention is to provide a method of treating petroleum heavy oil which is capable of easily effecting the separation of the extraction residue from the extraction solvent oil, as well as the recovery of the extraction solvent oil contained in the extraction residue or clinging to the surface of the extraction residue.

BRIEF DESCRIPTION OF THE DRAWING

The FIGURE is a flow diagram illustrating one embodiment of the process of the present invention.

DETAILED DESCRIPTION

In the method of treating heavy oil, according to the present invention, a gas and a volatile oil fraction are produced by the thermal decomposition of petroleum heavy oil and are distilled off, while the residue of the thermal decomposition is withdrawn in the liquid state and is brought into contact with a part of the volatile oil fraction, used as an extraction solvent, in the liquid state. The solvent-soluble component in the thermal decomposition residue is thereby extracted, and then the extraction residue is separated from the extraction solvent in the form of solid particles. According to the improvement of the present invention, the volatile oil fraction used as the extraction solvent is separated into two or more sub-fractions (or cuts) having different boiling point ranges by recovering the respective sub-fractions as separate side streams on condensing the volatile oil fraction in a fractionating column. The resulting sub-fractions having different boiling point ranges are brought into contact with the thermal decomposition residue in succession, starting with the solvent sub-fraction having the highest boiling point range followed by the sub-fraction(s) having progressively lower boiling point range(s), thereby to extract a solvent-soluble component from the thermal decomposition residue.

Further, another embodiment of the method of the present invention is characterized by the feature that the extraction residue, obtained by extracting the solvent-soluble component from the thermal decomposition residue, is washed with a reflux oil which is then flowed, as reflux, to the top of the fractionating column used to obtain the volatile oil fraction produced by thermal decomposition, as described above. In this way, the extraction solvent remaining in and clinging to the extraction residue is washed off and is replaced by some of the reflux oil.

An extraction solvent fraction, obtained from the volatile oil fraction produced by thermal decomposition of petroleum heavy oil, is used as the extraction solvent. The extract solvent fraction, preferably having an overall boiling point range of from 200° to 550° C., is fractionated into two or more sub-fractions, which are separately condensed and recovered. The resulting sub-fractions are brought into contact with the thermal decomposition residue in succession, in the order of their boiling point ranges starting with the sub-fraction having the highest boiling point range and ending with the sub-fraction having the lowest boiling point range, thereby accomplishing extraction of the solvent-soluble component of the thermal decomposition residue. No increase in energy consumption is needed to carry out the fractionating procedure for recovering the volatile oil sub-fractions used as the extraction solvent. The oil extract extracted from the thermal decomposition residue can be subjected either to a stabilizing treatment by hydrogenated desulfurization or to dehydrogenated decomposition, without being separated from the extraction solvent, or it can be used as an intermediate material in a catalytic thermal cracking process.

The extraction residue produced in the extraction step is washed with reflux oil which is then passed, as reflux, to the top of the fractionating column used to obtain the volatile oil fraction produced by the thermal decomposition of the starting heavy oil feedstock. The extraction solvent oil fraction which is contained in the extraction residue and clings to the surface thereof after extraction is completed, is replaced by the reflux oil fraction according to the washing procedure described above. The reflux oil is lighter, i.e. it has a lower boiling point range, than the extraction solvent oil fraction. The light reflux oil fraction used in the washing step is refluxed to the top of the fractionating column, and the extraction solvent oil fraction contained therein is separated in the fractionating column, regenerating the volatile oil fraction with no increase in energy consumption.

The petroleum heavy oil used as the feedstock in the present invention can be crude oil, atmospheric distillation residual oil, and vacuum distillation residual oil.

The petroleum heavy oil used as the starting material is continuously and rapidly heated in a tubular furnace, preferably up to an outlet temperature of from 450° to 550° C., and then is subjected to a thermal decomposition reaction in a reactor at a temperature of from 350° to 500° C., an absolute pressure of from 1 to 20 atmospheres, and a residence time of from 1 to 10 hours. The extent to which the thermal decomposition reaction is allowed to proceed in the reactor should be such that the thermal decomposition residue thereof is not converted into solid coke, but rather, remains in the state of pitch so that it can be handled as a liquid. On the other hand, when the thermal decomposition proceeds to an excessively low or insufficient extent, the separation of solids by extraction is made difficult. Thus, the content of quinoline insolubles in the pitch removed, as the thermal decomposition residue, from the reactor should be preferably in the range of from 5 to 50% by weight. The volatile oil fraction contained in the pitch can be subjected to stripping by injecting open steam directly into the thermal decomposition reactor under atmospheric pressure.

Generally, the pitch contains hexane (or pentane) insolubles, benzene insolubles and quinoline (or pyridine) insolubles, in amounts that can be determined by the solvent fractionation process, as defined by JIS or the like. But if the extract oil obtained from the pitch is to be again subjected to thermal decomposition or if it is used as an intermediate in other purification processes, it is preferred that the extraction should be effected to such an extent that the extract oil contains substantially only up to benzene solubles, because when the heavy oil is extracted more severely to an extent exceeding the aforesaid extent, the amount of impurities, such as heavy metals, in the extract oil becomes excessive, and coke formation is liable to take place. No limitations, such as those described above, are required when the extract oil is to be mixed with heavy oil or vacuum distillation residual oil to be used as a fuel.

The total amount of the extraction solvent used is in the range of from 1 to 10 parts by weight, per one part by weight of the thermal decomposition residue, wherein the total amount of the extraction solvent is the sum of the amounts of the respective sub-fractions. The extraction temperature can vary depending on the overall boiling point range of the extraction solvent used, and is preferably in the range of from ambient temperature to 300° C.

The step of washing the extraction residue with the light reflux oil fraction, which reflux oil is then refluxed to the top of the fractionating column, is preferably carried out at a temperature of from ambient temperature to a temperature below the boiling point of the light reflux oil used. The amount of the light reflux oil fraction used is preferably in the range of from 0.5 to 5 parts by weight, per one part by weight of the extraction residue.

An embodiment of the present invention will be explained with reference to the accompanying drawing. A heavy oil starting material is continuously introduced into a tubular furnace 2 through line 1 and it is rapidly heated in the furnace to 450° to 550° C. The heated heavy oil is then introduced into a reactor 4 through a line 3 and it is subjected to thermal decomposition at a temperature of from 350° to 500° C., using a residence time of from 1 to 10 hours, and an absolute pressure of from 1 to 20 atmospheres. The gas and volatile decomposition oil vapor thereby generated are withdrawn from the top of the reactor 4 and are introduced, via line 5, into the lower end of a fractionation column 6. In the fractionation column 6, the decomposition oil vapor is brought into contact with reflux oil introduced to the top thereof and is fractionated and condensed, whereby a fraction suitable to be used as the extraction solvent, namely, a fraction having an overall boiling point range of from 200° to 550° C., is withdrawn from the fractionating column in the form of two or more separate side streams of different cut temperature ranges, thereby providing sub-fractions. For example, three side streams having progressively lower boiling point ranges can be recovered via lines 11, 12 and 13, respectively.

The thermal decomposition residue is withdrawn, in the liquid state, from the reactor 4 via the line 21 by a pump 22, and is introduced into a multi-stage or multi-layer extractor 23 wherein said thermal decomposition residue flows downwardly countercurrent to the upwardly flowing extraction solvent sub-fractions. The thermal decomposition residue is contacted first with the side stream sub-fraction having the highest boiling point range introduced from line 11 by a pump 14, and then is brought into contact with the side stream sub-fractions having successively lower boiling point ranges introduced from lines 12 and 13 by pumps 15 and 16, respectively, for extracting solubles from the thermal decomposition residue. A mixed oil comprising a mixture of the extracted solubles (oil) and the combined extraction solvent sub-fractions is withdrawn through line 10 at the top end of the extractor 23.

The extraction residue is withdrawn from the bottom of the extractor 23, in the form of solids, by phase separation. The extraction residue has been last contacted with the lightest (lowest boiling) sub-fraction of the extraction solvent, and is thus withdrawn from the extractor 23 with some of the lightest fraction clinging thereto or contained therein. The residue thus extracted is, if required, further introduced into a washing column 24, and is brought into contact with a light reflux oil fraction. This light reflux oil fraction is obtained by separation and recovery from the gas and oil vapor distilled off from the top of the fractionating column 6 by means of a condenser 7 and separator 17. The light reflux oil fraction is introduced into the washing column 24 via a pump 18 and line 19. The extraction solvent contained in or clinging to the extraction residue is replaced by the light reflux oil fraction. The remainder of the light oil from the separator 17, other than that portion passed to the washing column 24, is withdrawn out of the system as product through the line 9. Uncondensed gases are taken out of the system through line 8.

The light reflux oil fraction recovered from the washing column 24, and which contains the extraction solvent, is refluxed, via line 20, to the top of the fractionating column 6.

The washed extraction residue is introduced into a separating-drying apparatus 25, whereby the oil clinging thereto is recovered to be withdrawn out of the system through line 26.

In a comparative process wherein a useful oil fraction contained in the thermal decomposition residue is extracted with an extraction solvent which is a relatively heavy fraction of the volatile oil fraction produced by thermal decomposition, separation of the heavy extraction solvent contained in or clinging to the extraction residue is generally difficult. According to the present invention, however, separation of the extraction residue and recovery of the oil fraction contained in or clinging thereto can readily be performed by utilizing the fractionating column in the thermal decomposition system without need for any particular additional apparatus or additional energy.

The present invention will be explained in greater detail by the following illustrative example. In the example, the term % means percent by weight.

EXAMPLE

A preheated, vacuum distillation column bottom oil (vacuum residue) obtained from Middle and Near East crude oil, which has a sulfur content of 4%, an API specific gravity of 7° and a Conradson Carbon residue of 20%, is introduced continuously into a tubular furnace at a flow rate of 100 kg/hr, is heated to 490° C., and then is passed into an atmospheric pressure reactor having an inner volume of 300 l and equipped with a stirrer, and is subjected therein to the thermal decomposition reaction. The gas and volatile oil fraction thus produced are continuously withdrawn from the top of the reactor, and the pitch (thermal decomposition residue) thus produced is continuously withdrawn from the bottom of the reactor so that the liquid level in the reactor is maintained constant. The temperature in the reactor is 420° C., and the average residence time is 2 hours. The yields of the gas, volatile oil fraction and pitch coming from the reactor are approximately 5%, 60% and 35%, respectively. The content of benzene insolubles in the pitch is approximately 50%.

Using a 20 l-extractor equipped with a stirrer, in one comparative experiment, the pitch withdrawn from the bottom of the reactor is introduced at 300° C. into the extractor at a flow rate of 35 kg/hr. A single volatile oil fraction having a boiling point range of 250° to 510° C., derived from the oil produced by thermal decomposition, is withdrawn from the fractionating column at a flow rate of 50 kg/hr, passed to the extractor and mixed with the pitch therein. The extraction residue is withdrawn from the bottom of the extractor in the slurry state so that the level within the extractor can be maintained constant. Then, 100 kg of the slurry is subjected to vacuum filtration, using a vacuum of 200 mmHg, batchwise, through a filter having openings of 100$\mu$ in size. It takes 40 minutes to complete the filtration procedure. After the completion of filtration, the resulting cake is heated to 350° C. under a vacuum of 10 mmHg and thereby is dried.

In an experiment according to the invention, the vapor of the volatile oil fraction produced by the thermal decomposition is fractionated in the fractionating column into three sub-fractions having different boiling point ranges of (1) 250° to 300° C., (2) 300° to 400° C., and (3) 400° to 510° C., respectively. Each of the sub-fractions is withdrawn from the fractionating column, the flow rates of the respective sub-fractions being (1) 16 kg/hr, (2) 20 kg/hr and (3) 14 kg/hr, respectively. The sub-fraction (1) having the boiling point range of from 250° to 300° C. is introduced at a flow rate of 16 kg/hr at the bottom of a cylindrical multi-stage extractor having an interior volume of 20 l, a diameter of 50 mm and a length of 1000 mm. The sub-fraction (2) having the boiling point range of from 300° to 400° C. is introduced into the extractor at a position 300 mm above the bottom thereof at a flow rate of 20 kg/hr, and the sub-fraction (3) having the boiling point range of from 400° to 510° C. is introduced thereinto at a position 600 mm above the bottom thereof at a flow rate of 14 kg/hr. The pitch is introduced into the extractor at the uppermost portion thereof at a flow rate of 35 kg/hr so as to be subjected to countercurrent extraction due to the specific gravity difference between the pitch and the solvent sub-fractions, the temperature of the respective sub-fractions each being 100° C.

100 kg of the slurry withdrawn from the bottom of the extractor is subjected to filtration as described above. The filtration procedure is completed in only 3 minutes. Moreover, the cake resulting from the filtration is then dried sufficiently at 350° C. under atmospheric pressure. If the aforesaid cake, prior to being dried, is washed with a decomposition naphtha at a flow rate of 20 kg/hr and the naphtha and oil extracted from the cake are refluxed to the top of the fractionating column, the cake can be dried sufficiently at 150° C. under atmospheric pressure. The naphtha and extracted oil resulting from the washing step are refluxed to the top of the fractionating column by a pump, with the overall result being that no change is caused in the operating conditions of the fractionating column.

We claim:

1. In a process of treating heavy oil, in which a gas and a volatile oil fraction produced by thermal decomposition of petroleum heavy oil are distilled therefrom, the residue of the thermal decomposition is withdrawn in a liquid state and then is brought into contact with an extraction solvent comprising a part of said volatile oil fraction to extract the component of said thermal decomposition residue that is soluble in said extraction solvent, and then an extraction residue is separated as solid particles from said extraction solvent, the improvement which comprises: fractionating said volatile oil fraction used as said solvent into two or more sub-fractions having different boiling point ranges from each other on condensing the volatile oil fraction in a fractionating column, and contacting said sub-fractions with said thermal decomposition residue in succession according to the boiling point ranges thereof, beginning with the fraction having the highest boiling point range and proceeding with the remaining fractions in descending order of boiling point ranges, to thereby extract the component soluble in said extraction solvent.

2. In a process of treating heavy oil, in which a gas and a volatile oil fraction produced by thermal decomposition of petroleum heavy oil are distilled therefrom, the residue of the thermal decomposition is withdrawn in a liquid state and then is brought into contact with an extraction solvent comprising part of said volatile oil fraction to extract the component of said thermal decomposition residue that is soluble in said solvent, and then an extraction residue is separated as solid particles from said extraction solvent, the improvement which comprises: fractionating said volatile oil fraction used as said extraction solvent into two or more fractions having different boiling point ranges from each other on condensing the volatile oil fraction in a fractionating column, contacting said fractions having different boiling point ranges with said thermal decomposition residue in succession according to the boiling point ranges thereof beginning with the fraction having the highest boiling point range and proceeding with the remaining fractions in descending order of boiling point ranges, to extract a solvent-soluble component, and washing the solid extraction residue with a light oil which is then refluxed to the top of the fractionating column used to fractionate said volatile oil fraction produced by the thermal decomposition, to thereby replace extraction solvent contained in and clinging to said extraction residue with said light oil.

3. A process according to claim 1 or claim 2, wherein said extraction solvent has an overall boiling point range of from 200° to 550° C.

4. A process according to claim 1 or claim 2, wherein said heavy oil is selected from the group consisting of crude oil, atmospheric distillation residual oil, and vacuum distillation residual oil.

5. A process according to claim 1 or claim 2, wherein said thermal decomposition residue is pitch having a content of quinoline-insoluble compounds in the range of from 5 to 50% by weight.

6. A process according to claim 1 or claim 2, wherein said solvent-soluble component contains only hexane and benzene soluble compounds.

7. A process according to claim 2, wherein said light reflux oil is used in an amount of from 0.5 to 5 parts by weight, per one part by weight of said extraction residue.

8. A process according to claim 1, claim 2 or claim 7, wherein said extraction solvent is used in an amount in the range of from 1 to 10 parts by weight, per one part by weight of said thermal decomposition residue, and said extraction step is conducted at a temperature in the range of from ambient temperature to 300° C.

9. A process for thermal decomposition of heavy petroleum oil, comprising the steps of:

(a) feeding heavy petroleum oil into a heating zone wherein said heavy oil is rapidly heated to a temperature of from 450° to 550° C.;

(b) then introducing said heavy oil into a thermal decomposition reactor maintained at a temperature of from 350° to 500° C. and an absolute pressure of from 1 to 20 atmospheres, thereby thermally decomposing said heavy oil over a period of from 1 to 10 hours while withdrawing from the top of said reactor a gaseous mixture produced by said thermal decomposition comprising a gas and a volatile oil vapor, and withdrawing a liquid thermal decomposition residue from the bottom of said reactor;

(c) then introducing said gaseous mixture into a fractionation column at the lower end thereof, wherein said gaseous mixture is brought into contact with reflux oil introduced at the top of said column, whereby part of said volatile oil vapor is condensed to form a liquid volatile oil fraction having a boiling point range of 200° to 550° C., and said volatile oil fraction is separated into two or more liquid oil sub-fractions having different boiling point ranges, said sub-fractions being separately withdrawn from said column, and a second gaseous mixture comprising a light oil fraction and said gas is withdrawn from the top of said column;

(d) introducing said thermal decomposition residue to the upper end of an extractor while simultaneously and separately introducing said liquid oil sub-fractions having different boiling point ranges into spaced-apart locations in said extractor, the one of said fractions having the lowest boiling point range being introduced nearest the bottom of said extractor, and the remainder of said fractions being introduced at successively upwardly displaced positions such that each of said fractions has a higher boiling point range than all of the fractions introduced beneath it, each of said fractions being brought successively into contact with said thermal decomposition residue and acting as an extraction solvent effective to extract oil contained therein, and withdrawing and recovering a mixed oil product comprising a mixture of said sub-fractions and extract oil contained therein from the top of said extractor, and withdrawing extraction residue from the bottom of said column;

(e) condensing said second gaseous mixture to obtain a light liquid oil, recovering part thereof as a light oil product and refluxing the remainder thereof to said fractionation column as said reflux oil; and (f) drying said extraction residue to form a solid cake.

10. A process as claimed in claim 9, further comprising the steps of:

(g) introducing into a washing column the reflux part of said light liquid oil produced in step (e) and said extraction residue produced in step (d) and washing said extraction residue with said light oil; and (h) then refluxing said light oil into said fractionation column at the top thereof.

* * * * *